US007976351B2

(12) United States Patent
Boemmel et al.

(10) Patent No.: US 7,976,351 B2
(45) Date of Patent: Jul. 12, 2011

(54) ELECTRICAL CONTACT

(75) Inventors: Christian Otto Boemmel, Langen (DE); Rolf Jetter, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/711,081

(22) Filed: Feb. 23, 2010

(65) Prior Publication Data

US 2010/0210154 A1 Aug. 19, 2010

Related U.S. Application Data

(63) Continuation of application No. PCT/EP2008/060968, filed on Aug. 21, 2008.

(30) Foreign Application Priority Data

Aug. 30, 2007 (DE) ..... 10 2007 040 937

(51) Int. Cl.
*H01R 13/432* (2006.01)

(52) U.S. Cl. ..... 439/748

(58) Field of Classification Search ..... 439/748, 439/746, 872, 851, 850, 843, 877
See application file for complete search history.

(56) References Cited

U.S. PATENT DOCUMENTS

| | | | | |
|---|---|---|---|---|
| 3,562,698 | A | 2/1971 | Merry | |
| 4,726,792 | A | 2/1988 | Shindo | |
| 5,259,796 | A * | 11/1993 | Yamada et al. | 439/843 |
| 5,441,428 | A * | 8/1995 | Hamai et al. | 439/843 |
| 5,695,368 | A * | 12/1997 | Joly et al. | 439/748 |
| 5,741,162 | A | 4/1998 | Kourimsky et al. | |
| 5,911,603 | A * | 6/1999 | Mansutti | 439/748 |
| 5,951,336 | A * | 9/1999 | Seko et al. | 439/745 |
| 6,019,646 | A * | 2/2000 | Okamura et al. | 439/852 |
| 6,024,612 | A * | 2/2000 | Myer et al. | 439/852 |
| 6,062,918 | A * | 5/2000 | Myer et al. | 439/839 |
| 6,106,339 | A * | 8/2000 | Nagai | 439/748 |
| 6,290,553 | B1 * | 9/2001 | Sato et al. | 439/843 |
| 6,672,910 | B2 * | 1/2004 | Hotea | 439/843 |
| 6,905,376 | B2 * | 6/2005 | Chen | 439/852 |

(Continued)

FOREIGN PATENT DOCUMENTS

DE 19745532 A1 4/1998

(Continued)

OTHER PUBLICATIONS

International Search Report for co-pending International Application No. PCT/EP2008/060968, dated Feb. 23, 2009, 3 pages.

PCT IPR cited in International Application No. PCT/EP/2008/060968, dated Oct. 20, 2009, 7 pages.

PCT WO cited in International Application No. PCT/EP2008/060968, dated Feb. 23, 2009, 4 pages.

*Primary Examiner* — T C Patel
*Assistant Examiner* — Harshad C Patel
(74) *Attorney, Agent, or Firm* — Barley Snyder LLC

(57) ABSTRACT

The invention relates to a terminal for connection with an electrical mating connector, and having a catch spring projecting therefrom for latching the terminal in a housing. The terminal includes a catch spring projecting from the terminal and having a cross-section having a first and second area, the catch spring is assembled with regard to its cross-section over substantially its entire extent in the direction of a longitudinal axis of the terminal. The first and second area are arranged bent relative to one another by a transitional area or are connected together in such a manner that they merge continuously.

19 Claims, 5 Drawing Sheets

U.S. PATENT DOCUMENTS

| | | | | |
|---|---|---|---|---|
| 7,101,233 | B2 * | 9/2006 | Maeda | 439/852 |
| 7,192,318 | B2 | 3/2007 | Hotea et al. | |
| 7,241,190 | B2 * | 7/2007 | Smyk | 439/852 |
| 7,278,891 | B2 * | 10/2007 | Cvasa et al. | 439/852 |
| 7,303,447 | B1 * | 12/2007 | Tyler | 439/748 |
| 7,530,859 | B2 * | 5/2009 | Moll et al. | 439/852 |
| 2007/0178775 | A1 * | 8/2007 | Morello et al. | 439/877 |
| 2008/0146091 | A1 * | 6/2008 | Tyler | 439/843 |

FOREIGN PATENT DOCUMENTS

| | | | |
|---|---|---|---|
| DE | 19933211 | A1 | 1/2000 |
| DE | 102005004241 | A1 | 8/2006 |
| EP | 0821438 | A1 | 1/1998 |
| EP | 1643598 | B1 | 9/2007 |

* cited by examiner

ELECTRICAL CONTACT

CROSS-REFERENCE TO RELATED APPLICATIONS

This application is a continuation of PCT International Application No. PCT/EP2008/060968, filed Aug. 21, 2008, which claims priority under 35 U.S.C. §119 to German Patent Application No. DE 10 2007 040 937.2, filed Aug. 30, 2007.

FIELD OF THE INVENTION

The invention relates to an electrical connector, and in particular, a terminal having a catch spring projecting from the contact for latching the terminal into a housing.

BACKGROUND

Electrical terminals generally include a connection area for a cable and a plug-in area having a receptacle, which forms a receiving space for an electrical pin contact. The receptacle generally includes a base plate with two side walls, an upper free edge of one side wall being bent over the base plate. When the pin contact is plugged into the terminal, the side walls and the base plate of the receptacle secure the pin contact mechanically in the terminal, while a contact spring provides electrical connection. The contact spring is generally located in the receptacle, and is generally constructed as one piece with the terminal. On the opposite side of the terminal, away from the receptacle, the electrical conductor may preferably be connected mechanically using a crimp termination and electrically through a contacting weld point or a crimp termination.

By simply plugging the pin contact into the terminal, an electrical connection is formed for a cable in a short time. Terminals of straight and angled construction are used for the widest possible range of electrical plug-in connectors. For instance, there are direct or indirect tab receptacles (terminals) for detachable electrical contacting of a printed circuit board with backplane wiring. In addition, terminals serve to bring devices into releasable terminal with one another or to bring an electrical device into releasable terminal with a power supply. Moreover, terminals are used in particular in the automotive sector.

In order to latch a terminal into a housing, the terminal includes a catch spring, which may project from a top wall of the terminal. Such terminals are generally formed from a blank, which is stamped from sheet metal. A gap arises between the catch spring and a side the top wall of the terminal, wherein, during assembly of the terminal with the electrical conductor, the conductor commonly becomes entangled under the catch spring. This hinders positioning and use of the cable and may under certain circumstances lead to damage to the terminal, which, due to the desire to make the blank smaller and thinner, makes it more susceptible to be easily damaged.

EP 0 821 438 A1 (DE 697 26 346 T2) discloses an terminal that latches in a housing by means of a catch spring, wherein the catch spring is provided on a top wall of the terminal and projects from the top wall. To prevent the electrical cable from becoming entangled between the catch spring cut free from the top wall and the top or side walls of the terminal, the catch spring includes, at its free longitudinal end portion, lateral guard members. These lateral guard members are bent at a right angle out of the plane of the catch spring towards the terminal and so cover that area which is most widely open between the catch spring and the rest of the terminal. The ends of the guard members adjacent the free end of the catch spring are inclined or cut diagonally, in order to prevent acute-angled edges on the catch spring or the guard members thereof.

As technology progresses, the above-mentioned miniaturisation for such electrical connectors is further desired, which raises new problems with regard to terminal construction and design. Ever greater significance and attention is provide to a stable latching of the terminal despite its small structural size, a prevention of catch spring buckling, and a prevention of the cable becoming entangled under the catch spring during the positioning and assembly of the electrical cable.

SUMMARY

It is therefore an object of the invention to provide an improved terminal. In particular, it is an object of the invention to provide a terminal which latches stably in a housing despite its minimized structural size, with which buckling of a catch spring on loading of the terminal is prevented and entangling of the cable under the catch spring is avoided.

The terminal includes a catch spring projecting from the terminal and having a cross-section having a first and second area, the catch spring is assembled with regard to its cross-section over substantially its entire extent in the direction of a longitudinal axis of the terminal. The first and second area are arranged bent relative to one another by a transitional area or are connected together in such a manner that they merge continuously.

BRIEF DESCRIPTION OF THE DRAWINGS

The present invention is illustrated in greater detail below by exemplary embodiments with reference to the attached drawings, in which.

DETAILED DESCRIPTION OF THE EMBODIMENT(S)

The invention is explained in greater detail below with reference to the drawings.

The discussion below relates to a front portion or a rear portion of the terminal. In this case, front is intended to mean a position on the terminal which is located in the vicinity of a free end of a receptacle or in the vicinity of a free end of an connection box of the terminal. Accordingly, rear means a position on the terminal, which is arranged at a distance from the free end of the receptacle or of the connection box.

Figure 1:
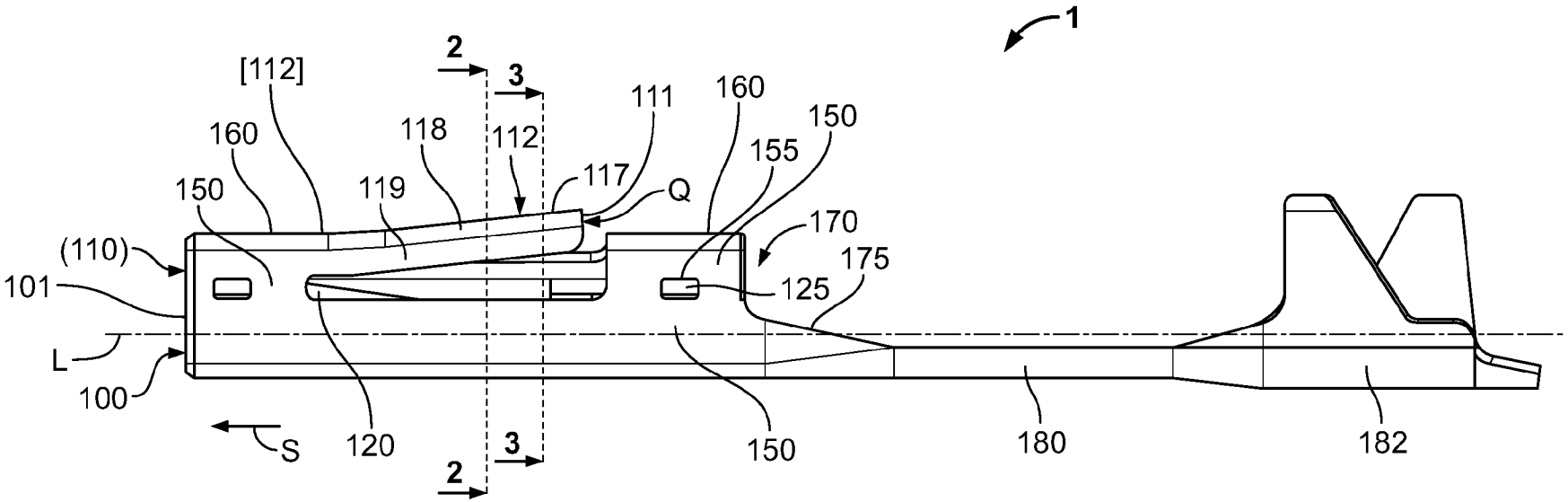
FIG. 1 is a side view of a terminal according to the invention.

A terminal 1 according to the invention, illustrated in side view in FIG. 1, includes a front portion for locking in a housing (not shown) and for electrically contacting a pin contact (not shown). In addition, the terminal 1 has a rear portion for electrical connection of a cable 2 (see FIG. 5).

The rear portion of the terminal 1 may include a first crimp portion 180 (see also FIGS. 5 to 7) for crimping on a conductor 200 of the cable 2. In other embodiments of the invention, the portion 180—as shown in FIG. 1—make take the form of a portion for welding on the electrical conductor 200. This may be performed using a compacting welding method. In addition, the rear portion of the terminal 1 includes a second crimp portion 182 for crimping on electrical insulation 210 of the cable 2. Furthermore, at the rear end of the second crimp portion 182 the terminal 1 may include a carrier 190 with transport openings provided therein, by means of which a blank (see FIG. 7, in which the carrier 190 is not shown, however) of the terminal 1 may be transported after being stamped out of sheet metal and held for bending into shape. In addition, the carrier 190 may serve for holding the terminal 1 during compacting welding and/or making up of the cable 2. The carrier 190 is removed for use of the terminal 1.

For connection with an electrical mating connector (not shown), the front portion of the terminal 1 include a receptacle 100, whose bottom wall 130 (see FIGS. 2 to 4) is connected to the portion 180 or first crimp portion 180. In addition, at the point of transition between the receptacle 100 and the portion 180 or the crimp portion 180 there is in each case located a reinforcing web 175 adjoining the two side walls 140, 150 of the receptacle 100.

Hereinafter, a first embodiment of the terminal 1 in the form of a terminal is explained in greater detail with reference to FIGS. 1 to 4. As may likewise be seen in FIG. 7 (second embodiment of the invention), FIGS. 1 to 4 show that the terminal 1 is bent into shape from a single blank stamped from sheet metal.

As is clear in FIG. 1, a catch spring 112 rises outwards away from the terminal 1. Here, the catch spring 112 rises outwards from the plane of the top wall 160 and provides resilient primary latching for the terminal 1. According to the invention, the catch spring 112 is both integral with the top wall 160 and integral with a side wall 150 of the terminal 1. In addition, a transitional area between the top wall 160 and the side wall 150 is also integral with the catch spring 112. The catch spring 112 extends substantially in a longitudinal direction L of the terminal 1.

The catch spring 112 being constructed preferably in one piece as regards material with the top wall 160 and a side wall 150, a cross-section Q of the catch spring 112 acquires an idealised two-dimensional structure, i.e. the cross-section Q (viewing direction indicated in FIG. 1 by an arrow) of the catch spring 112 has at least two fibres or areas or portions, which extend in each case in a different direction.

According to the invention, the cross-section of the catch spring 112 is constructed substantially over the entire longitudinal extent of the catch spring 112 with at least two fibres or two material layers, in such a way that these extend substantially in two different directions, in particular in two different orthogonal directions.

Figures 2, 3, 4:
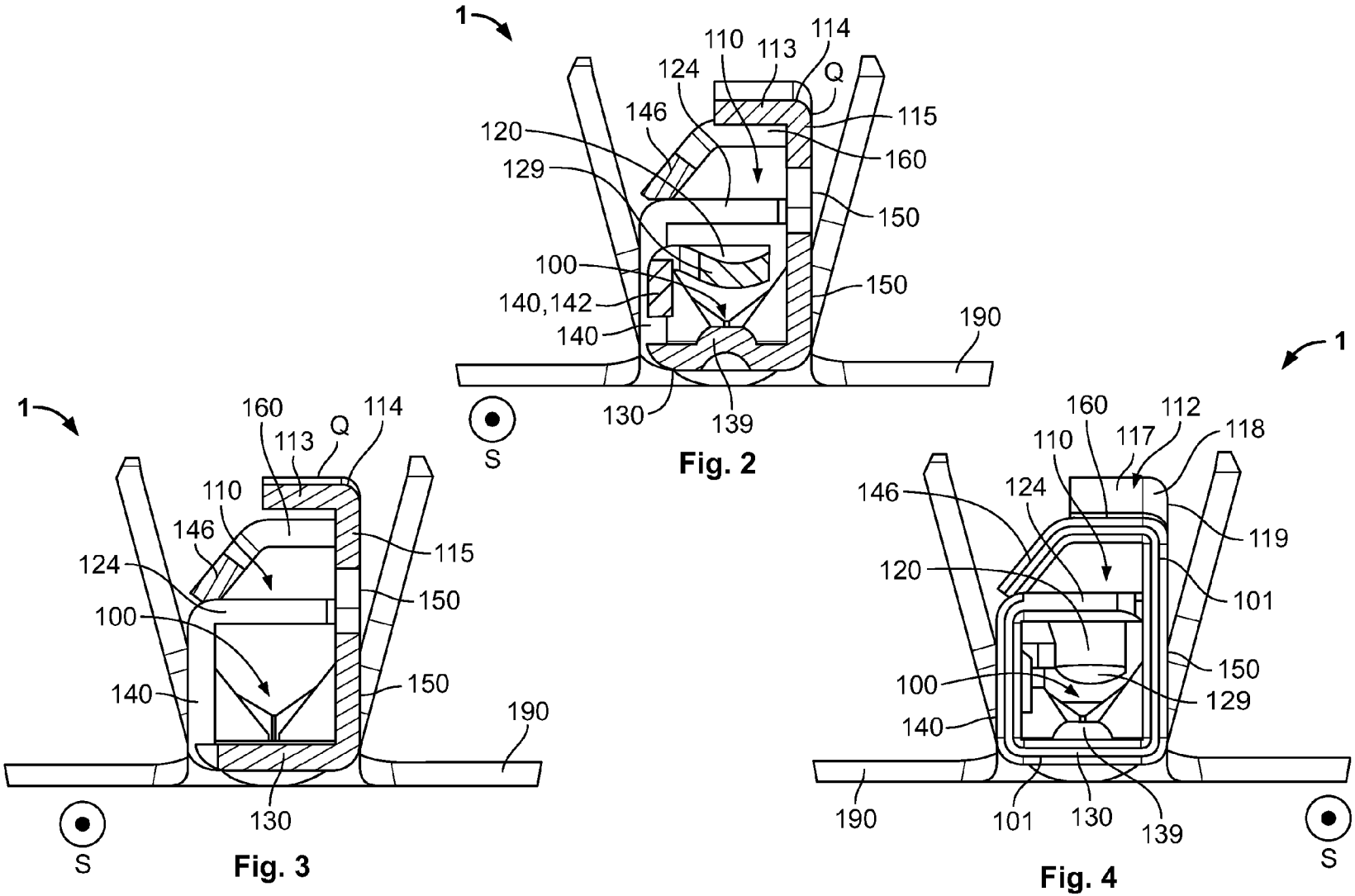
FIG. 2 is a sectional front view of the terminal according to the invention of FIG. 1, along a section plane indicated in FIG. 1.
FIG. 3 is a further sectional front view of the terminal according to the invention of FIG. 1, along a section plane indicated in FIG. 1.
FIG. 4 is a front view of the terminal of FIG. 1 according to the invention.

In the present example, the cross-section Q of the catch spring 112 is of L-shaped construction, which is clearly visible in section in FIGS. 2 and 3. In this case, the cross-section Q is composed of two areas, a first and second area 113, 115, the two of which are connected by a transitional area 114, which takes the form of a bend or kink. In the embodiment shown, the first area 113 is longer than the second area 115 substantially orthogonal thereto. In addition, the first and second areas 113, 115 are of equal thickness.

This structure according to the invention of the cross-section Q of the catch spring 12 with two areas, the first and second areas 113, 115, extend over the entire length of the catch spring 112, i.e. all the cross-sections Q of the catch spring 112 are of similar construction, being L-shaped in the present exemplary embodiment.

The respective areas, the first, second and transitional areas 113, 114, 115 of the cross-section Q of the catch spring 112 in each case together produce longitudinal portions (i.e. a first portion 117, a transitional portion 118, and a second portion 119) of the catch spring 112. The assembled longitudinal portions 117, 118, 119 thus produce the catch spring 112 according to the invention, wherein the respective longitudinal portions 117, 118, 119 merge integrally with the terminal 1. In this case it is possible to make the catch spring 112 in one piece with the receptacle 100 (not shown) or in one piece with an connection box 110 (see below).

According to the invention, in the longitudinal direction L of the catch spring 112 the cross-sections Q are preferably simply contiguous, wherein within each cross-section Q of the catch spring 112 in one area 113, 115 material mainly extends in one direction and in the other area 115, 113 material mainly extends in another direction in relation thereto. It is here of course also possible for the two areas 113, 115 not, as is shown in FIGS. 1 to 5, to merge together through a discontinuity point (kink or sharp bend) but rather continuously. This is the case, for example, with a cross-section Q of the catch spring 112, which takes the form partly of a circular or elliptical ring. In this case, the material extends within the cross-section Q initially mainly in one direction and continuously develops along the fibre (in particular in the case of a semicircular profile) into the other direction.

The second embodiment of the invention is explained in greater detail below. The comments made in relation to the first embodiment are intended also to apply to the second embodiment. Conversely, it is possible for the statements made in relation to the second embodiment of the invention to be applied to the first embodiment, which is not absolutely necessary however. In addition, embodiments of the invention are possible which, unlike the representations in the drawings, do not have to include an connection box 110 provided separately from the receptacle 100, i.e. the catch spring 112 according to the invention may be provided on an electrical receptacle 100 without such a terminal 1 having to include an connection box 110.

Figure 5:
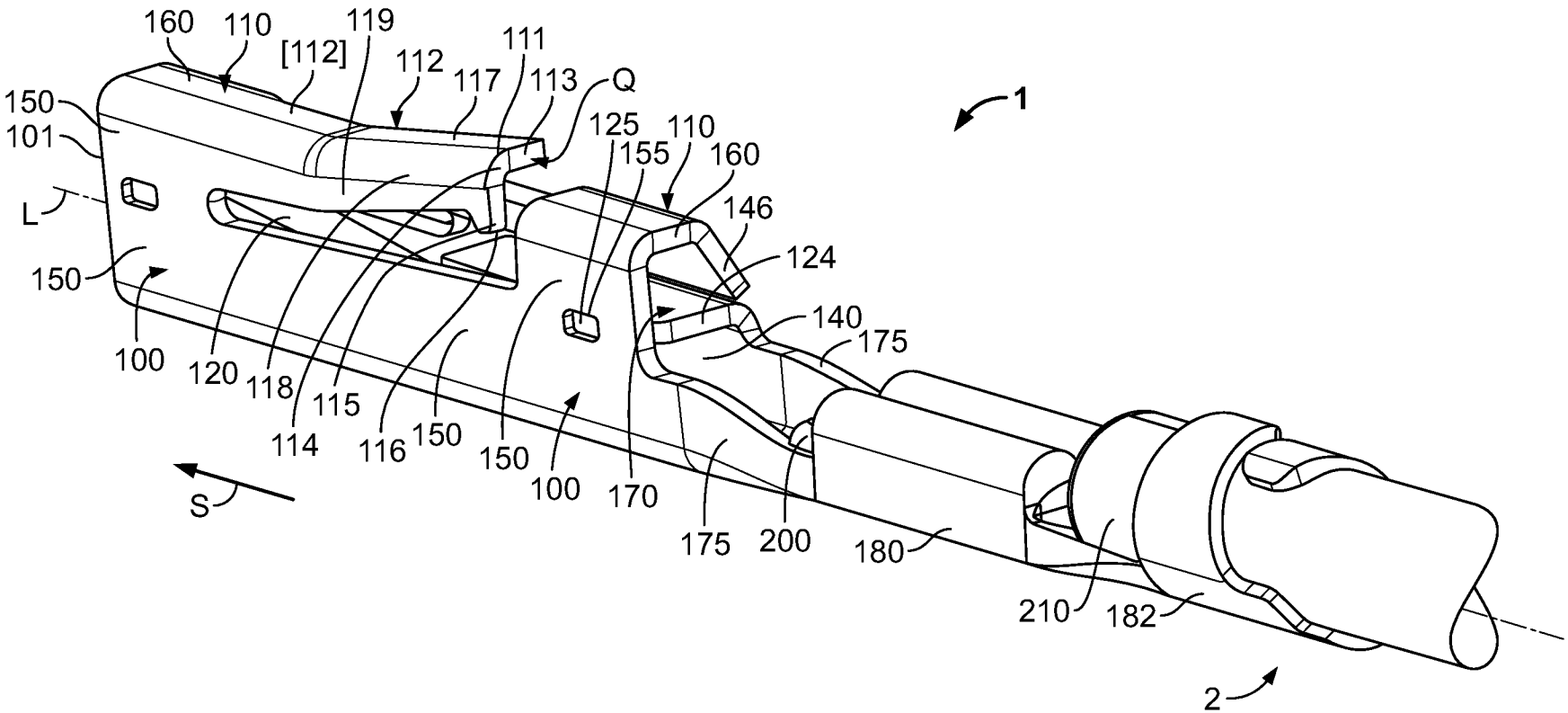
FIG. 5 is a perspective view from a rear of a another embodiment of the terminal according to the invention.
Figure 6:
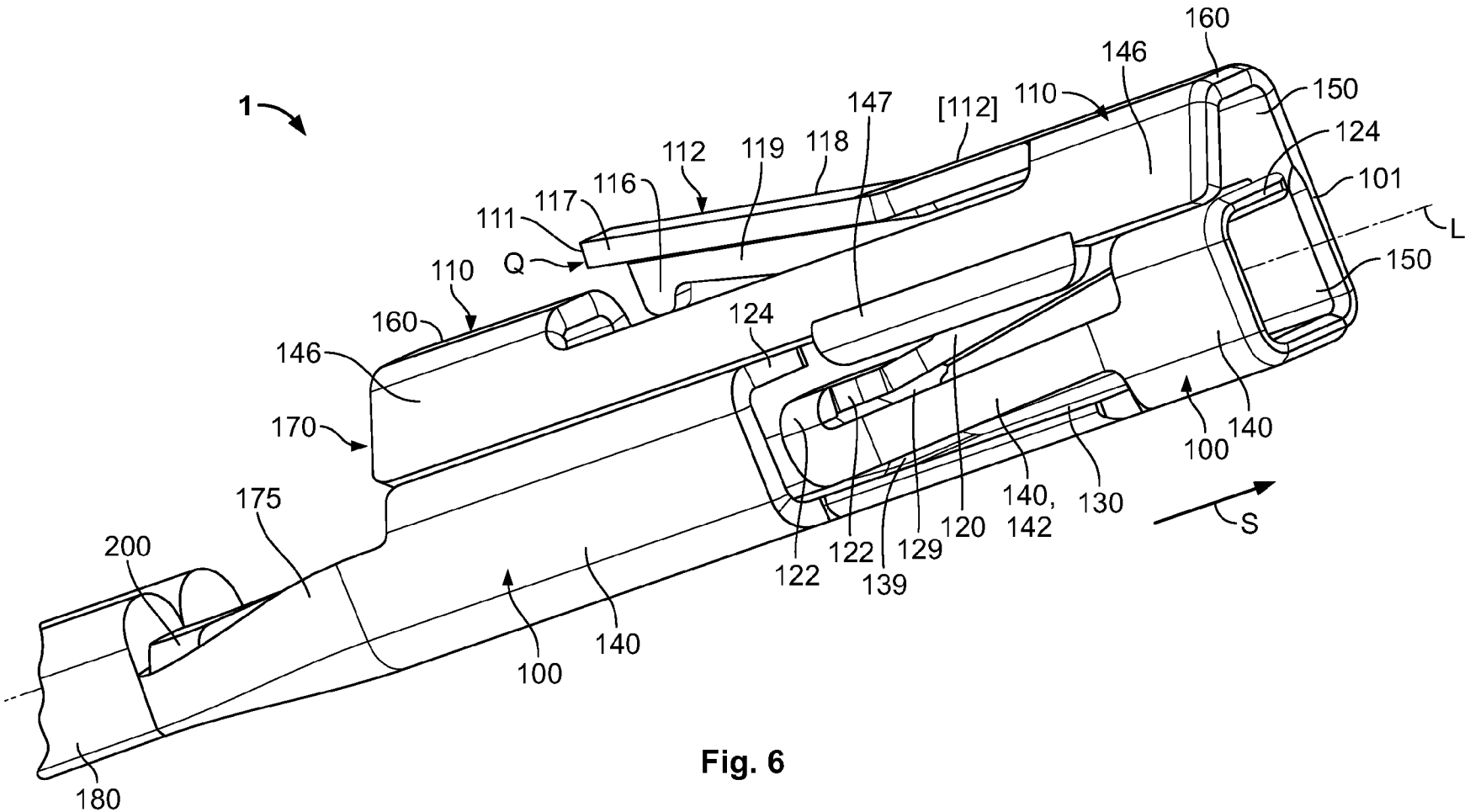
FIG. 6 is a perspective view from a front of the terminal shown in FIG. 5.
Figure 7:
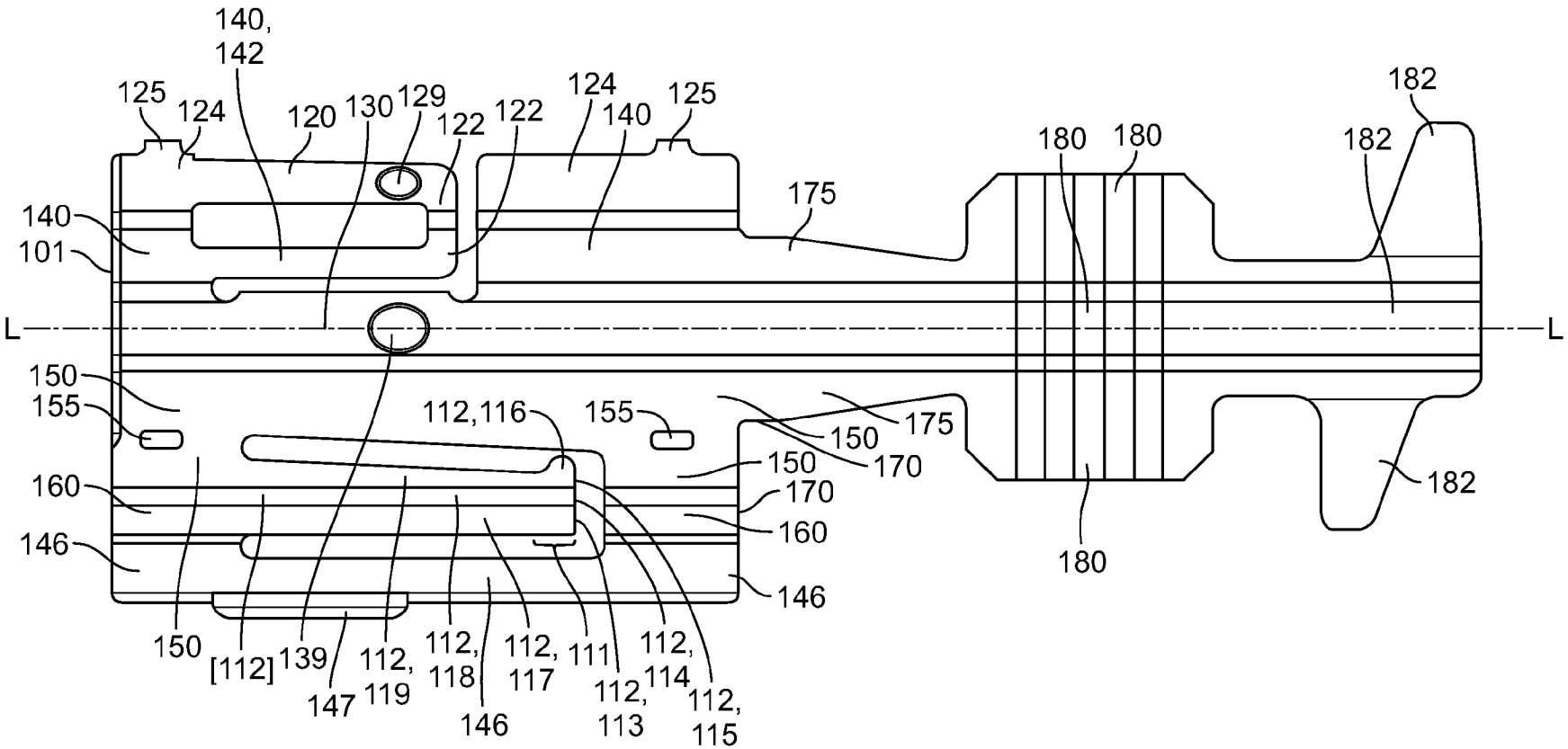
FIG. 7 is a plan view of a blank of the terminal of FIGS. 5 and 6 before assembly and bending.

Once bent into shape (see FIGS. 5 and 6), the second embodiment of the invention illustrated in FIGS. 5 to 7 includes the receptacle 100 and the connection box 110 arranged thereabove. In this case, the connection box 110 is separated from the electrical receptacle 100 by means of an intermediate wall 124. In this case, the intermediate wall 124 may be provided all the way through the terminal 1, between the receptacle 100 and the connection box 110 or only in places (as shown).

The receptacle 100 and the connection box 110 have a common side wall 150, to which the intermediate wall 124 is fixed. In order to fix the intermediate wall 124 in a central area of the side wall 150, the intermediate wall 124 includes projections 125 (see FIG. 7), which engage in corresponding recesses 155 in the side wall 150. In this way, a cross-sectionally rectangular, preferably square, cuboid receptacle 100 extending in the longitudinal direction L is formed, whose bottom wall 130 lies opposite the intermediate wall 124. The side wall 150 and the side wall 140 are each perpendicular thereto.

Starting from the free end 101 of the intermediate wall 124 and going rearwards in the longitudinal direction L of the terminal 1, the intermediate wall 124 develops into a electrical contact spring 120, which serves in electrically contacting with an electrical male connector. Here, the contact spring 120 tapers in a rearwards direction and projects into the receptacle 100, starting from the intermediate wall 124, i.e. the contact spring 120 extends away from the connection box 110, arranged thereabove into the receptacle 100.

At the opposite end of the electrical contact spring 120 from the free end 101 of the intermediate wall 124, the contact spring 120 merges with a transitional portion 122 formed thereon with a portion 142 of the side wall 140. In this case, the portion 142 is cut out or free from the side wall 140. Reference may here in particular also be made to FIG. 7, which shows the bent configuration of intermediate wall 124, contact spring 120, its transitional portion 122 and the portion 142 of the side wall 140 and the side wall 140.

In the embodiment shown, the portion 142 of the side wall 140 and the electrical contact spring 120 are of resilient design, i.e. the electrical contact spring 120 may be moved up and down inside the receptacle 100 (in relation to the connection box 110 arranged thereabove), and the portion 142 of the side wall 140 may be moved in a direction perpendicular thereto laterally in and out of the receptacle 100. In this way, a pin contact of a mating plug connector (not shown) may be easily inserted into a miniaturized terminal 1.

To improve electrical contacting, the electrical contact spring 120 includes a first electrical contacting zone 129, in the embodiment shown. A second electrical contacting zone 139 may also be included along the bottom wall 130, wherein the first electrical contacting zone 129 of the contact spring 120 and the second electrical contacting zone 139 of the bottom wall 130 lie directly opposite one another. Such electrical contacting zones 129, 139 takes the form, for example, of an elevated portion, bump, bead, convex portion, rib or projection.

Further to the rear, beginning in a central area of the terminal 1, the intermediate wall 124 is again provided (see also FIG. 7), extending as far as a rear area of the receptacle 100 or of the connection box 110. At this end, preferably at the rear of the connection box 110, there is located an edge or recess 170, which may serve in secondary latching of the terminal 1.

The connection box 110 is arranged above or on the receptacle 100. Starting from the side wall 150 in common with the receptacle 100, the top wall 160 of the terminal 1 or of the connection box 110 engages over the receptacle 100 or the intermediate wall 124, wherein the top wall 160 then develops into a top lug 146, which is positioned on the receptacle 100. In this case, a free elongate end of the top lug 146 sits against the intermediate wall 124 or against a transitional portion between the intermediate wall 124 and the side wall 140.

Preferably, the top wall 160 is not as wide as the bottom wall 130 or the intermediate wall 124, such that the top lug 146 is not aligned with the side wall 140 of the terminal 1 and thus is arranged at a given angle thereto other than 180°. This gives rise to an oblique surface, which makes one end face of the terminal 1 asymmetrical, whereby by means of the obliquely arranged top lug 146 coding may be provided for the terminal 1.

In the embodiment shown, the catch spring 112 according to the invention is located on the connection box 110. In this case, the catch spring 112 configured as explained above has been cut free from the connection box 110 and projects partly from the connection box 110, as is clearly visible in FIGS. 5 and 6.

As shown, not the entire cut-free area of the catch spring 112 may be provided partly projecting from the connection box 110, but rather only a free longitudinal end portion thereof. In the embodiment shown, this free longitudinal end portion is longer than 50% of the portion cut free from the connection box 110. The portion remaining inside the shape of the connection box 110 and adjoining the catch spring 112 is designated [112].

At one free end 111 of the catch spring 112 the latter includes an overextension guard 116. In this case, the overextension guard 116 may be provided as an elevated portion, bump, bead, convex portion, rib or projection on the catch spring 112, on the longitudinal portion 119 thereof. The overextension guard 116 may be situated at the free end 111 of the longitudinal portion 119 of the catch spring 112. In this way, the overextension guard 116 may sit on a cut-free border of the side wall 150 and so limit movement of the catch spring 112 inwards into the connection box 110.

If, therefore, a terminal 1 which has been inserted and secured in a housing the primary latching (catch spring 112) may be released by depression. This movement releasing the primary latching is then stopped by the overextension guard 116 coming to rest on the side wall 150, such that the catch spring 112 cannot be moved too far forward into the connection box 110 and the catch spring 112 or the rest of the terminal 1 cannot be damaged.

According to the invention, the top lug 146 includes a protective lug 147, which covers an area of the receptacle 100 that is open in certain embodiments of the invention. In this case, this open area arises, in particular, as a result of a resilient configuration of the portion 142 of the side wall 140 or a resilient configuration of the contact spring 120. The protective lug 147 prevents the cable 2 from becoming caught in this area.

The configuration according to the invention of the terminal 1 is suitable in particular for "snap-in" terminals, which have already been latched in a housing prior to connecting with a mating plug connector. The design according to the invention of the catch spring 112 gives rise to a relatively high level of security against buckling of the catch spring 112 and cables 2 no longer become entangled between catch spring 112 and terminal 1 or between catch spring 112 and connection box 110.

The invention gives rise to a comparatively large cross-sectional area of the catch spring 112, whereby advantages are obtained when latching the terminal 1 in the housing. If mechanical forces on the terminal 1 arise contrary to a (mounting) plug-in direction S of the terminal 1, the free end 111 of the catch spring 112 does not enter or barely enters into the material of the housing. This is particularly advantageous with a comparatively flexible plastics housing. Furthermore, the invention is applicable to comparatively large terminals, which are exposed to comparatively heavy mechanical loading, contrary to their plug-in direction S.

In embodiments of the invention, the cross-section Q of the catch spring 112 or the idealised graph curve thereof may comprise at least one turning point, the mathematical curvature behaviour of the cross-section Q reversing at the turning point of the cross-section. One example of such a cross-section is an assembled cross-section Q, in which for example two straight areas 113, 115 merge continuously by means of a transitional area 114. In this case, each straight area 113, 115 of the cross-section Q lies in a plane which is arranged parallel to the area of the respective other plane, wherein the two straight areas 113, 115 merge by means of the approximately S-shaped transitional area.

As a result of the construction, according to the invention, of the cross-section Q over the entire length of the catch spring 112, a higher moment of resistance is obtained compared with a prior art catch spring 112. This gives rise, according to the invention, to stable latching of the terminal 1 in the case of small structural size. The increased moment of resistance prevents buckling of the catch spring 112 upon loading in the longitudinal direction thereof. Through knowledge of the moment of resistance of the catch spring 112, it is possible—given a linear mechanical stress distribution over the cross-section Q of the catch spring 112—to directly calculate the maximum bending stress of the cross-section Q or, in the case of a cross-section Q varying over the length of the catch spring 112, the maximum bending stress at the smallest cross-section Q (in the sense of the lowest moment of resistance). Accordingly, the terminal 1 or the catch spring 112 thereof may then be designed in such a way as to be able to withstand a given maximum force.

In particular in embodiments of the invention in which a longitudinal portion 117 of the catch spring 112 has been cut free from the side wall 140 of the terminal 1, entanglement of cables 2 between the catch spring 112 and the rest of the terminal 1 may be effectively prevented. This also applies when the catch spring 112 on the directly opposing side has not been cut free from a side or a sloping top wall 160. In this way, the invention simplifies making up of the electrical cable 2 and on the other hand effectively prevents damage to the terminal 1—in particular in small or very small embodiments.

Besides these, the configurations described in the above-described embodiment can be selected optionally or can be changed appropriately in to other configurations without departing from the spirit and scope of the present invention.

The invention claimed is:

1. A terminal for connection with an electrical mating connector and latching in a housing, comprising:

a catch spring projecting from the terminal;

a connection box, wherein the catch spring is cut free from the connection box;

an electrical receptacle, wherein the connection box is separated from an electrical receptacle by an intermediate wall; and a cross-section of the catch spring having a first and second area, the catch spring is assembled with regard to its cross-section over substantially an entire extent in the direction of a longitudinal axis of the terminal;

wherein the first and second area are arranged bent relative to one another by a transitional area or are connected together in such a manner that they merge continuously.

2. The terminal according to claim 1, wherein the areas of the cross-section of the catch spring form an angle with one another of approximately 30°, approximately 45°, approximately 60°, approximately 75°, approximately 90°, approximately 105°, approximately 120°, approximately 135°, approximately 150° or approximately 165°.

3. The terminal according to claim 1, wherein the cross-section (Q) further includes a transitional area, the first, second and transitional areas take the form of a circular or elliptical ring.

4. The terminal according to claim 3, wherein the transitional area includes a turning point where the curvature behaviour of the cross-section of the catch spring changes.

5. The terminal according to claim 3, further comprising one longitudinal portion of the catch spring is cut free from a transitional portion from the top wall to the side wall of the terminal.

6. The terminal according to claim 5, wherein a cross-section of this longitudinal portion forms the transitional area of the cross-section of the catch spring.

7. The terminal according to claim 1, wherein one longitudinal portion of the catch spring is cut free from a side wall of the terminal.

8. The terminal according to claim 7, wherein a cross-section of the longitudinal portion forms the second area of the cross-section of the catch spring.

9. The terminal according to claim 1, wherein one longitudinal portion of the catch spring is cut free from a top wall of the terminal.

10. The terminal according to claim 9, wherein a cross-section of the longitudinal portion forms the individual area of the cross-section of the catch spring.

11. The terminal according to claim 1, further comprising one longitudinal portion of the catch spring having an over-extension guard for the catch spring sitting on a side wall.

12. The terminal according to claim 11, wherein the over-extension guard is located on a free longitudinal end portion of the catch spring.

13. The terminal according to claim 1, wherein the connection box is arranged on the electrical receptacle.

14. The terminal according to claim 1, further comprising an electrical contact spring joined on at least one side of the intermediate wall.

15. The terminal according to claim 14, wherein the electrical contact spring is connected by a transitional portion to a portion of a side wall of the terminal cut free from the side wall.

16. The terminal according to claim 1, wherein the electrical contact spring protrudes into the electrical receptacle.

17. The terminal according to claim 14, wherein the electrical contact spring includes a first electrical contacting zone.

18. The terminal according to claim 17, further comprising a second electrical contacting zone located along a bottom wall, wherein the first electrical contacting zone of the contact spring and the second electrical contacting zone of the bottom wall lie opposite one another.

19. The terminal according to claim 1, wherein the connection box includes a top lug, by means of which the catch spring rests on the electrical receptacle of the terminal.

* * * * *